US008043129B2

(12) United States Patent
Schoten et al.

(10) Patent No.: US 8,043,129 B2
(45) Date of Patent: Oct. 25, 2011

(54) QUICKLY EXCHANGEABLE SWITCHING DEVICE IN FIXED TYPE MEDIUM VOLTAGE SWITCHGEAR SYSTEM

(75) Inventors: Frederik Paul Schoten, Nijverdal (NL); Arend Jan Willem Lammers, Hengelo (NL)

(73) Assignee: Eaton Electric B.V., Hengelo (NL)

( * ) Notice: Subject to any disclaimer, the term of this patent is extended or adjusted under 35 U.S.C. 154(b) by 113 days.

(21) Appl. No.: 12/669,872

(22) PCT Filed: Sep. 8, 2008

(86) PCT No.: PCT/NL2008/050592

§ 371 (c)(1),
(2), (4) Date: Jan. 20, 2010

(87) PCT Pub. No.: WO2009/031900

PCT Pub. Date: Mar. 12, 2009

(65) Prior Publication Data

US 2010/0200379 A1 Aug. 12, 2010

(30) Foreign Application Priority Data

Sep. 7, 2007 (EP) ..... 07115964

(51) Int. Cl.
*H01R 4/38* (2006.01)

(52) U.S. Cl. ..... 439/805; 439/926

(58) Field of Classification Search ..... 439/805, 439/921, 926; 361/335
See application file for complete search history.

(56) References Cited

U.S. PATENT DOCUMENTS

| | | | | | |
|---|---|---|---|---|---|
| 2,246,901 | A * | 6/1941 | Schwarzmann | ..... | 200/19.32 |
| 3,727,109 | A * | 4/1973 | Kozlovic | ..... | 361/615 |
| 3,952,273 | A * | 4/1976 | Rogers | ..... | 337/7 |
| 3,991,348 | A * | 11/1976 | Evans | ..... | 361/621 |
| 4,491,831 | A * | 1/1985 | Sakai et al. | ..... | 340/677 |
| 4,955,823 | A * | 9/1990 | Luzzi | ..... | 439/507 |
| 6,325,675 | B1 * | 12/2001 | Harmeyer | ..... | 439/709 |
| 6,520,795 | B1 * | 2/2003 | Jazowski | ..... | 439/475 |
| 2010/0255728 | A1 * | 10/2010 | Matsuoka et al. | ..... | 439/607.55 |

FOREIGN PATENT DOCUMENTS

| | | | |
|---|---|---|---|
| DE | 43 12 620 | A1 | 10/1994 |
| JP | 10-201026 | A | 7/1998 |
| JP | 2003-16881 | A | 1/2003 |
| WO | 01/50563 | A1 | 7/2001 |

* cited by examiner

*Primary Examiner* — Phuong Dinh
(74) *Attorney, Agent, or Firm* — Eckert Seamans Cherin & Mellott, LLC; Kirk D. Houser, Esquire

(57) ABSTRACT

Switching device assembly for providing a switching function in a medium voltage switchgear system. A switching device (10) is positioned in a switching device housing (11). Terminals (14, 15) are connected to the switching device (10) and receiving ends (24, 25) thereof are provided for receiving an interface surface (26, 27) of respective conductor terminals (20, 21) of the medium voltage switchgear. Mounting assemblies are arranged to releasably fasten the terminals (14, 15) to the respective conductor terminals (20, 21) in operation. A switching device drive unit (30), to which the switching device housing (11) is mounted, is provided with sealable access points (31, 32), through which the mounting assemblies are reachable when opened.

11 Claims, 3 Drawing Sheets

Figure 1:
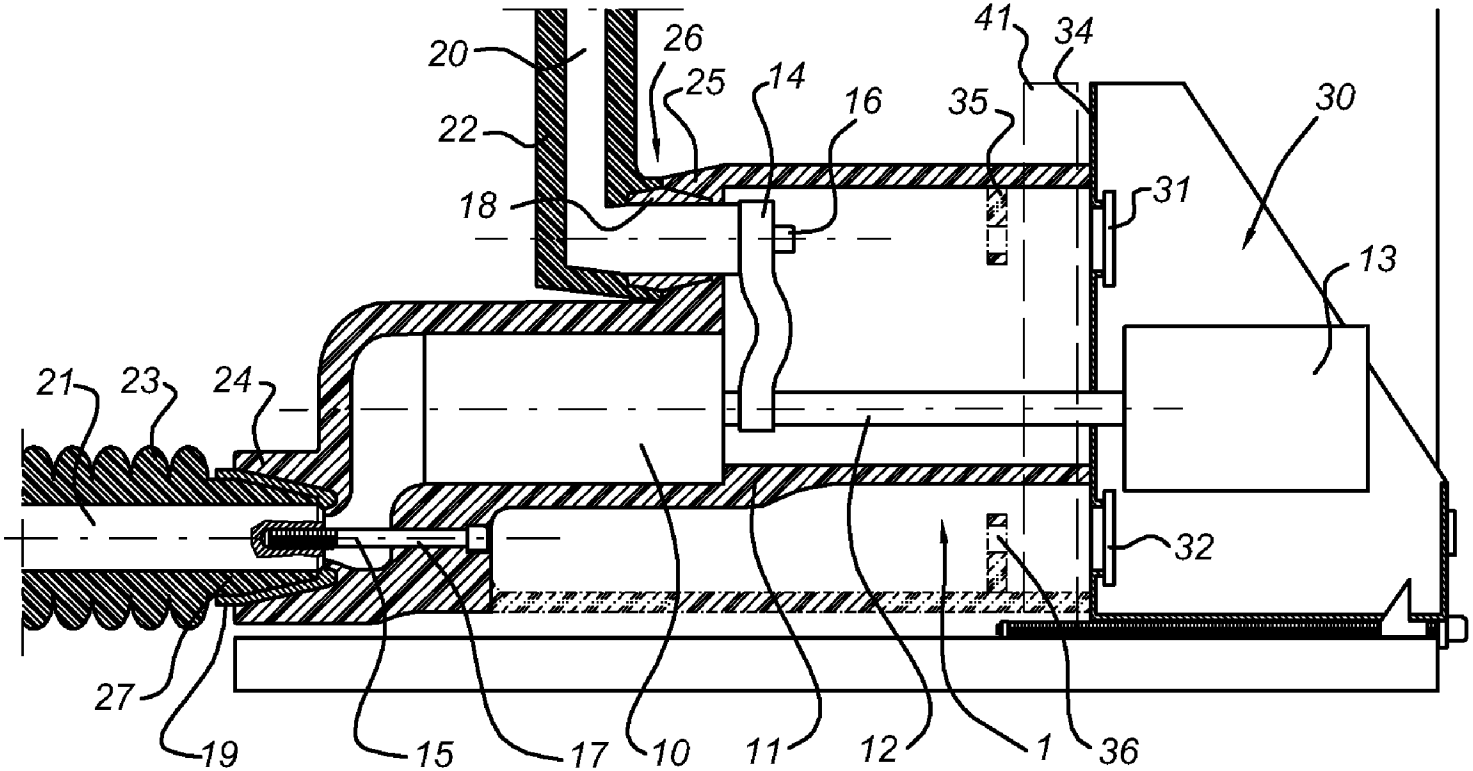

QUICKLY EXCHANGEABLE SWITCHING DEVICE IN FIXED TYPE MEDIUM VOLTAGE SWITCHGEAR SYSTEM

FIELD OF THE INVENTION

The present invention relates to a switching device assembly for providing a switching function in a medium voltage switchgear system, comprising a switching device housing of insulating material, and a switching device positioned in the switching device housing. In a further aspect, the present invention relates to a medium voltage switchgear system comprising a switching device assembly. In this application a switching device is understood to be a device able to make or break an electrical contact between at least two terminals, e.g. a main switching device, a circuit breaker, an interrupter, a disconnector, etc.

PRIOR ART

Medium voltage type switchgear systems according to the current IEC-standards are in general available in two types, i.e. withdrawable switchgear systems and fixed switchgear systems. Switching devices or circuit breakers in withdrawable type of switchgear systems are mounted on a truck or cradle arrangement and are removable instantaneously. This is advantageous e.g. on occasions when a switching device has to be removed from a system, e.g. for inspection or maintenance of the internal elements of the system, or for removal or exchange of the switching device (e.g. in case of malfunction). In fixed switchgear systems, the main switching device is mounted in a fixed manner, not allowing an easy removal or exchange of switchgear elements, such as the switching device. As a drawback, the withdrawable systems require mechanically complex subsystems, such as the truck or cradle, interlocks, and shutter constructions, and are in general more voluminous because the withdrawable switching device also means a less optimal dielectric design of the switchgear system. Also usually, the flexible contacts required for withdrawable systems have a higher contact resistance.

SUMMARY OF THE INVENTION

The present invention seeks to provide an improved construction for incorporating a switching device assembly in a fixed-type (medium voltage) switchgear system, i.e. a system which utilizes a switching device that is connected to the primary electrical circuit with fixed contacts, meaning that contact surfaces are connected with bolts or the equivalent, as opposed to flexible contacts where contact surfaces are connected with a clamping device of some sort that allows immediate loosening of the connection.

According to the present invention, a circuit breaker assembly according to the preamble defined above is provided, in which the switching device assembly further comprises a first and a second terminal connected to the switching device and receiving ends at the location of the first and second terminal for receiving a first and a second interface surface of respective conductor terminals of the medium voltage switchgear, a first and second mounting assembly which is arranged to releasably fasten the first and second terminal to the respective conductor terminals in operation, and a switching device drive unit to which the switching device housing is mounted, in which the switching device drive unit is provided with first and second sealable access points, through which the first and second mounting assembly, respectively are reachable when opened.

In this manner, a compact switchgear system may be provided combining the advantageous elements of both fixed and withdrawable systems. In operation the first and second terminals are fastened to the respective conductor terminals so that they are in conductive contact with each other. At the same time the terminals can be detached in order to withdraw the switching device from the switchgear. The system is maintenance free, as no regular cleaning or inspection is necessary. The drive unit allows to seal off the space in which the switching device is positioned entirely, as in known fixed switching gear installations. However, when necessary, the sealable access points can be used to gain access to the mounting assemblies, allowing interchange of components (e.g. the switching device) when necessary in a relatively short time period.

In a further embodiment, the first and second mounting assembly and respective sealable access points are arranged to be accessible by an operating tool from the same direction. The switching device assembly is provided with two mounting assemblies, and by making these accessible from the same direction, a single tool can be used from a convenient side of the switchgear installation, e.g. the front side.

The switching device assembly, in a further embodiment, comprises sleeves at the receiving ends, and the first and second mounting assembly are further arranged to seal off the conductor terminals and the first and second terminal using the sleeves. Using sleeves allows to obtain a completely sealed off connection, like in fixed switchgear systems, which prevent any possible occurrence of flashover or other electrical phenomena influencing the safe operation of the switchgear installation. The sleeves may be from a compressible material, such as rubber or silicone material. By compressing the material, it is ensured that no air pockets remain in the connection area. In order to ensure a proper and reliable electrical insulation at the connections between terminals of the switch gear assembly and the terminals associated with the conductor terminals in the switchgear system, the (compressible) sleeves are provided along substantially the entire exposed surface of the receiving ends.

In a further embodiment, the receiving ends and associated first and second interface surfaces are conically shaped. This provides ease of assembly, as the connecting parts of the switch gear assembly and associated parts in the switchgear system are self-centering. Furthermore, in this embodiment, the mounting assemblies allow to put pressure on the connecting terminals in a very efficient manner, at the same time enhancing the insulation function of the sleeves. In an exemplary embodiment, the first and second mounting assemblies comprise screw means, such as connection bolts, which can be easily operated using standard tools.

In an even further embodiment, the switching device drive unit comprises a quick release mechanism for separating the switching device assembly from the switchgear system by pulling the first and second receiving ends from the first and second interface surfaces, respectively. Such a quick release mechanism is arranged to exert the mechanical forces necessary to separate the contacts of the switching device assembly, especially in case compressible sleeves are applied, by human operator intervention only. This is especially useful when exchanging a switching device assembly. The term exchange comprises the following sequence of actions: A) removal of a switching device assembly from the switchgear system; B) subsequent remounting of that same switching device assembly (e.g. after inspection and/or repair) or mounting of another switching device assembly of the same construction (e.g. in case the removed switching device assembly is defect). Removal of the switching device assembly is carried out by the following sequence of actions: A1) switching the device out of service position and in earthed and safe position according to applicable safety regulations; A2) creating access to the quick release mechanism on the switching device assembly; A3) loosening the mechanical connection points and the fixed main contacts of the switching device assembly; A4) removing the switching device assembly from the switchgear system by engaging the quick release mechanism. Mounting of the same or an equivalent switching device assembly is the carried out by the reversed sequence of actions.

In a further aspect, the present invention relates to a medium voltage switchgear system comprising first and second interface surfaces of respective conductor terminals, and a switching device assembly according to any one of the present switching device assembly embodiments. In this manner a switchgear system is provided exhibiting the advantageous characteristics of both fixed and withdrawable platforms. I.e., a maintenance free system is provided, not necessitating regular inspection and cleaning, but in which it is possible to exchange a faulty switching device when necessary.

In an embodiment, a front panel is removable (from the switchgear installation) to allow access to the first and second mounting assemblies. This further enhances the easy access to the internal components of the switchgear system when necessary.

In a further embodiment, the medium voltage switchgear system is a three phase system, comprising a switching device assembly according to any one of the embodiments described above for each phase. Operation and possible maintenance can then be controlled for each phase separately. In a three phase system, the three switching devices of the switching device assemblies may be operated using a single drive unit, which has an advantage that less elements are needed. In a further embodiment, each switching device may be operated by an associated drive unit.

In a further embodiment, the switching device assembly comprises three switching devices and a single drive unit actuating the three switching devices.

SHORT DESCRIPTION OF DRAWINGS

Figure 2:
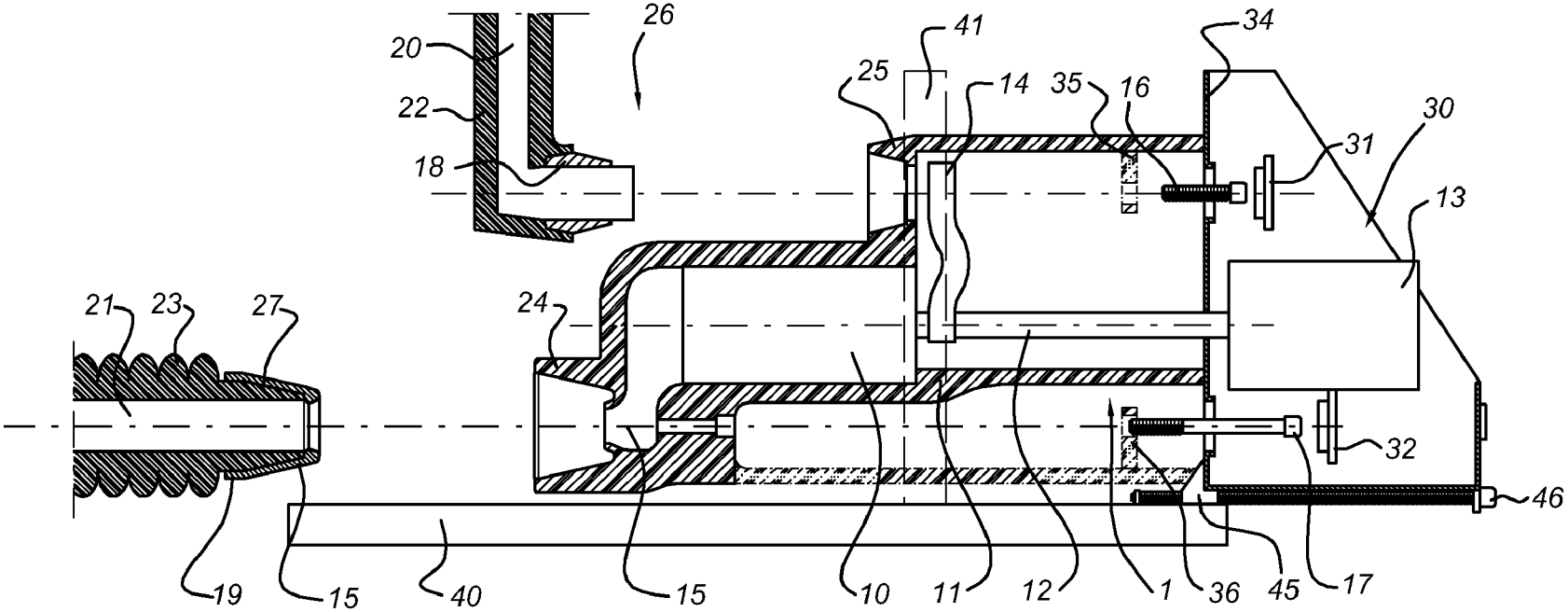
Figure 3A:
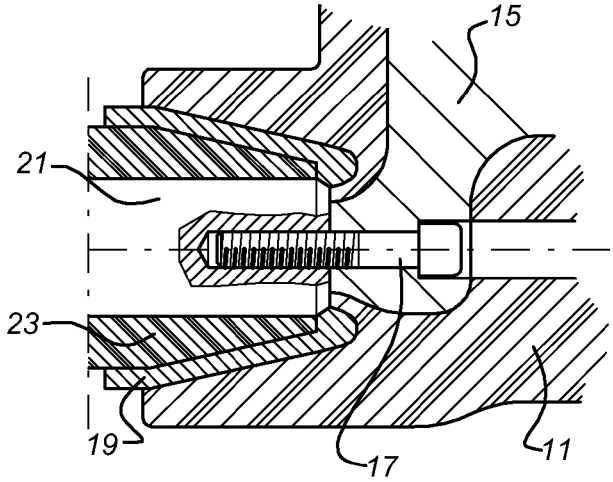
Figure 3B:
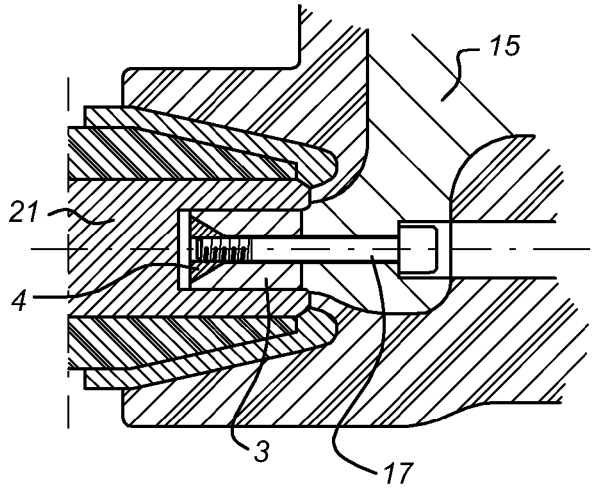
Figure 3C:
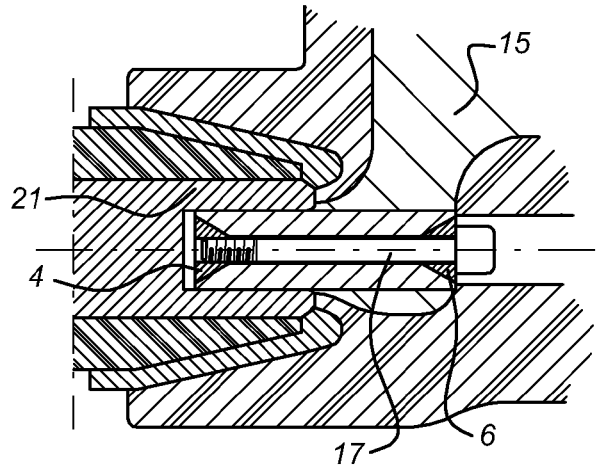

The present invention will be discussed in more detail below, using a number of exemplary embodiments, with reference to the attached drawings, in which FIG. 1 shows a cross sectional view of a part of a switchgear system with an embodiment of a circuit breaker assembly according to the present invention;

FIG. 2 shows a cross sectional view of the circuit breaker assembly of FIG. 1 in drawn-out position; and FIG. 3*a-c* show cross sectional views in detail of the attachment of lower conductor to fixed conductor using three further embodiments of the second mounting assembly.

DETAILED DESCRIPTION OF EXEMPLARY EMBODIMENTS

In medium voltage switchgear systems, a circuit breaker is the element which performs the actual switching function of the system. In an embodiment of the present invention, the circuit breaker 10 and associated elements form a circuit breaker assembly 1, which is removable as a whole from the switchgear system.

The circuit breaker 10 is an example of a switching device 10, which in its general meaning, is a device able to make or break an electrical contact between at least two terminals. Other examples include, but are not limited to a main switching device, a circuit breaker, an interrupter, a disconnector, etc.

A cross sectional view of the relevant part of the switchgear system is shown in FIG. 1. In the switchgear system, the circuit breaker 10 (switching device) performs the switching function between an upper system conductor 20 (first conductor terminal) and a lower system conductor 21 (second conductor terminal). The conductors 20, 21 are surrounded by cast resin insulation indicated by 22 and 23, respectively. The circuit breaker 10 is operated using a circuit breaker drive mechanism 13 by means of an (insulating) actuator rod 12. In operation, the circuit breaker 10 is connected to the upper conductor 20 using a flexible conductor 14 (first terminal) on the moving contact end, and to the lower conductor 21 using a fixed conductor 15 (second terminal) on the fixed contact end. The circuit breaker drive mechanism 13 is located in a circuit breaker drive unit 30 (switching device drive unit) having a sealing plate 34, to which e.g. the drive mechanism 13 (and other control elements) may be mounted. The sealing plate 34 fends off the space in which the circuit breaker 10 is located, in order to prevent dust and other materials to enter that space, which allows to keep the entire switchgear system maintenance free.

The circuit breaker assembly 10 further comprises an insulating circuit breaker assembly housing 11, e.g. of cast resin material, which surrounds the circuit breaker 10, but also flexible conductor 14, fixed conductor 15, and drive rod 12. The assembly housing 11 may be attached (e.g. using fixtures known as such) to the base plate 30 of the circuit breaker drive unit, to form a single removable element.

In FIG. 1 only a single circuit breaker assembly 1 is shown, but it will be clear that in a three phase switchgear system three circuit breakers 10 (and possibly three circuit breaker assemblies 1) are present.

The flexible conductor 14 is firmly attached to the upper conductor 20 using a first mounting assembly for releasably fastening the flexible conductor 14 to the upper conductor 20, e.g. comprising a fastener in the form of a bolt 16 co-operating with a screw thread (not shown) provided in the upper conductor 20, allowing a secure and reliable electrical connection. Similarly, the fixed conductor 15 is releasably fastened to the lower conductor 21 using a second mounting assembly, e.g. in the form of a bolt 17 and associated screw thread in the lower conductor 21.

In the cross sectional view of the embodiment of FIG. 1, the circuit breaker assembly 10 having a quick exchange function is shown, mounted in a normal operational position inside the switchgear system. It is clear that all primary conductors (i.e. conductors 20, 21 but also conductors 14, 15 and other parts in the compartment in which the circuit breaker assembly 1 is mounted) are insulated sufficiently, e.g. using cast resin material. A sufficient electrical insulation at the connection points of the circuit breaker assembly 10 to the conductors 20, 21 is ensured by a number of further technical features.

At the upper conductor 20, the end is provided with a conically shaped insulating sleeve 18, e.g. from a rubber material, of which the shape is mirrored from a conical receiving end 25 of the assembly housing 11. When connecting the upper conductor 20 to the flexible conductor 14 using the bolt 16, the sleeve 18 is compressed, ensuring proper sealing of the conductive parts, such that these are free from electrical flashover, and unsusceptible to pollution. The bottom conductor 21 is provided with a cast resin insulation 23, which at the end of the lower conductor 21 is provided with a conically shaped end. Again, the receiving end 24 of the assembly housing 11 is formed in a mirrored form, allowing to use a (straight) sleeve 19 of insulating (and compressible) material, e.g. rubber, to provide a sealing function when connecting the lower conductor 21 to the fixed conductor 15. This provides a maintenance free primary circuit in the switchgear system, eliminating the need for periodical inspection or maintenance. It will be clear that the specific embodiments of the upper and lower conductors 20, 21 and associated parts of the circuit breaker assembly 10 may be interchanged, or that the same type of construction may be used for both conductors 20, 21.

Quick removal of the circuit breaker assembly 10 according to the present invention is made possible by a number of further technical features. The sealing plate 34 is provided with sealable access points 31, 32, which in sealed configuration maintain an entirely sealed base plate 34 between the space 30 for drive mechanism 13 and the circuit breaker compartment. The access points 31, 32 prevent objects or pollution to enter the circuit breaker compartment in sealed configuration. The access points 31, 32 may however be removed, and then provide easy access to the bolts 16, 17 of the circuit breaker assembly 10. The construction of the switchgear system is such that the access points 31, 32 may be easily reached from a front panel of the switchgear system. A special tool can then be used to loosen the bolts 16, 17 from the same direction, i.e. the line between bolt 16 and access point 31 is substantially parallel to the line between bolt 17 and access point 32. Advantageously, the direction is perpendicular to a front panel 33 of the switch gear system.

Special provision can be made such that the bolts 16, 17 are held in their place in flexible conductor 14 and housing 11, respectively, eliminating the possibility of the bolts 16, 17 to fall down inside the housing 11 or switchgear system.

FIG. 1 also shows in dash line and in dash-dot line two alternatives for the insulating housing 11 at the bottom. In a first alternative, the housing 11 is enlarged near the lower bolt 17, to provide a retaining space for the bolt when unmounted. In a second alternative, the housing underside stretches over the entire circuit breaker housing 11 length, such that in assembled state the lower access point 32 provides entrance to the internal space of housing 11. This allows the tool to be used to tighten or loosen the bolt 17 to remain inside the insulating housing 11. The housing 11 may also be provided with guidance elements 35, 36 to guide the tool to the mounting assemblies.

Loosening of the bolts 16, 17 should of course only be carried out under (electrically) safe conditions, i.e. after the circuit breaker 10 is disconnected from the upper conductor 20 (connected in its turn to a main busbar of the switchgear system), and connected to earth, using means known as such.

After loosening the bolts 16, 17, the entire circuit breaker assembly may be removed out of the switchgear system, as shown in the cross sectional view of FIG. 2. This view also shows more clearly some of the structural elements 40, 41 of the switchgear system, such as a bottom plate 40 of the circuit breaker compartment and attachment frame 41 for the base plate 30.

As the connections between circuit breaker assembly 10 and conductors 20, 21 are quite sturdy (for providing sufficient sealing and contact force for ensuring the electrical connection), it may be required to provide additional removal devices or quick release mechanism for the circuit breaker assembly 10. The quick release mechanism may be formed by the combination of bottom plate 40, attachment frame 41, and force providing elements 45, 46. In FIG. 2, an exemplary embodiment is shown, using a nut 45 fixedly attached to the bottom plate 40 and associated rod with screw thread 46 which is fixedly attached to the base plate 30. Other quick release mechanisms, e.g. using levers are also possible. This allows an operator to exert a high force on the circuit breaker assembly 10, which pulls all contact points (six in the case of a three phase system) of the assembly loose form the counterparts in the switchgear system in a single well controlled movement. This is further made easy by the conical shape of the relevant parts of the circuit breaker assembly and associated parts in the switchgear system.

In FIG. 3*a*, a cross sectional view in detail is shown of the attachment of lower conductor 21 to fixed conductor 15 using the second mounting assembly. Similar as the implementation described with reference to FIG. 1, the lower conductor 21 is provided with a screw thread for receiving bolt 17 or equivalent screw means. The fixed conductor 15 is provided with a seating base to allow the bolt 17 to exert a force between the lower conductor 21 and fixed conductor 15 to provide a good electrical contact when tightened.

In FIG. 3*b*, a cross sectional view in detail is shown of the attachment of lower conductor 21 to fixed conductor 15 using a further embodiment of the second mounting assembly. In this embodiment, an attachment body 3 is provided, which can deform to provide a contact force between attachment body 3 and an inner surface of lower conductor 21. E.g. the attachment body 3 may be a cylindrical body with one or more longitudinal slits attached to the fixed conductor 15 (e.g. using soldering, welding or the like). The attachment body 3 is provided with a conical end face accommodating a conically shaped element 4. The conically shaped element 4 is provided with a screw thread to allow the bolt 17 or equivalent screw means to be fastened therein. When the bolt 17 is tightened, the conically shaped element 4 pushes the outer surface of attachment body 3 to an inner surface of lower conductor 21, thereby providing a good and solid electrical contact between lower conductor 21 and fixed conductor 15.

In FIG. 3*c*, a cross sectional view in detail is shown of the attachment of lower conductor 21 to fixed conductor 15 using an even further embodiment of the second mounting assembly. Here, both the fixed conductor 15 and the lower conductor 21 are provided with a cylindrical space accommodating a further attachment body 5. The attachment body 5 is provided e.g. with slits at both ends, allowing the end parts of attachment body 5 to increase in circumference to make a good and solid contact with the lower conductor 21 and fixed conductor 15, respectively. Again, the attachment body may be provided with a conically shaped end faces accommodating a conically shaped element 4 and a further conically shaped element 6. Again, when tightening bolt 17 or equivalent screw means, the circumference of the attachment body 5 increases at both ends thus providing the electrical contact between lower conductor 21 and fixed conductor 15.

It is noted that the first mounting assembly 16 may be implemented using similar arrangements as shown in FIG. 3*a*-3*c*. Also combinations of different arrangements as shown in FIG. 3*a*-3*c* can be used for the first and second mounting assembly.

The circuit breaker assembly 1 according to the above described embodiments may be advantageously used in a medium voltage switchgear system. When used in a three phase system, each phase may be provided with such a switching device assembly 1. Alternatively, the switching device assembly 1 comprises three switching devices 10 and a single drive unit 30 which actuates all three switching devices 10.

The invention claimed is:

1. Switching device assembly for providing a switching function in a medium voltage switchgear system, said switching device comprising a switching device housing of insulating material, a switching device positioned in the switching device housing, a first and a second terminal connected to the switching device and receiving ends at the location of the first and second terminal for receiving a first and a second interface surface of respective conductor terminals of the medium voltage switchgear, a first and second mounting assembly which is arranged to releasably fasten the first and second terminal to the respective conductor terminals in operation, and a switching device drive unit to which the switching device housing is mounted, in which the switching device drive unit is provided with first and second sealable access points, through which the first and second mounting assembly, respectively are reachable when opened.

2. The switching device assembly according to claim 1, in which the first and second mounting assembly and respective sealable access points are arranged to be accessible by an operating tool from the same direction.

3. The switching device assembly according to claim 1, in which the switching device assembly further comprises sleeves at the receiving ends, and in which the first and second mounting assembly are further arranged to seal off the conductor terminals and the first and second terminal using the sleeves.

4. The switching device assembly according to claim 3, in which the sleeves are provided along substantially the entire exposed surface of the receiving ends.

5. The switching device assembly according to claim 1, in which the receiving ends and associated first and second interface surfaces are conically shaped.

6. The switching device assembly according to claim 1, in which the first and second mounting assemblies comprise screw means, such as connection bolts.

7. The switching device assembly according to claim 1, in which the switching device drive unit comprises a quick release mechanism for separating the switching device assembly from the switchgear system by pulling the first and second receiving ends from the first and second interface surfaces, respectively.

8. A medium voltage switchgear system comprising first and second interface surfaces of respective conductor terminals, and the switching device assembly according to claim 1.

9. The medium voltage switchgear system according to claim 8, in which a front panel is removable to allow access to the first and second mounting assemblies.

10. The medium voltage switchgear system according to claim 8, in which the medium voltage switchgear system is a three phase system, comprising the switching device assembly for each phase.

11. The medium voltage switchgear system according to claim 8, in which the medium voltage switchgear system is a three phase system, comprising the switching device assembly, in which the switching device assembly comprises three switching devices and a single drive unit actuating the three switching devices.

* * * * *